US012624706B2

(12) United States Patent
Stoessel et al.

(10) Patent No.: US 12,624,706 B2
(45) Date of Patent: May 12, 2026

(54) HYDRAULIC PUMP AND MODULE FORMED FROM SUCH A HYDRAULIC PUMP AND A RECEPTACLE

(71) Applicant: Valeo Powertrain GmbH, Ebern (DE)

(72) Inventors: Roland Stoessel, Ebern (DE); Patrick Gegner, Ebern (DE); Katrin Ebert, Ebern (DE)

(73) Assignee: Valeo Powertrain GmbH, Ebern (DE)

( * ) Notice: Subject to any disclaimer, the term of this patent is extended or adjusted under 35 U.S.C. 154(b) by 354 days.

(21) Appl. No.: 18/329,634

(22) Filed: Jun. 6, 2023

(65) Prior Publication Data

US 2023/0407881 A1 Dec. 21, 2023

(30) Foreign Application Priority Data

Jun. 21, 2022 (DE) ..... 10 2022 115 407.6

(51) Int. Cl.
*F04D 29/40* (2006.01)
*F04D 13/06* (2006.01)
*F04D 29/60* (2006.01)

(52) U.S. Cl.
CPC ..... *F04D 29/406* (2013.01); *F04D 13/06* (2013.01); *F04D 29/605* (2013.01); *F04C 2240/30* (2013.01)

(58) Field of Classification Search
CPC ..... F04D 29/406; F04D 13/06; F04D 29/605; F04D 13/0606; F04D 13/0653; F04D 29/026; F04D 29/426; F04B 53/16; F04C 2240/30; F04C 2/3446; F04C 2/344; F04C 15/00; F04C 2240/10; F01C 21/10
See application file for complete search history.

(56) References Cited

U.S. PATENT DOCUMENTS 5,049,770 A * 9/1991 Gaeth ..... F04D 23/008 310/43
7,318,422 B2 * 1/2008 Douyama ..... F04B 17/03 123/495
10,830,251 B2 * 11/2020 Castillo ..... F04D 29/046
(Continued)

FOREIGN PATENT DOCUMENTS

DE 20 2004 013 907 U1 2/2006
DE 10 2017 215 107 A1 2/2019
(Continued)

OTHER PUBLICATIONS

German Search Report Issued Mar. 6, 2023 in German Application 10 2022 115 407.6 Filed on Jun. 21, 2022 (with English Translation of Categories of Cited Documents), 6 pages.
(Continued)

*Primary Examiner* — Dominick L Plakkoottam
(74) *Attorney, Agent, or Firm* — Oblon, McClelland, Maier & Neustadt, L.L.P.

(57) ABSTRACT

A hydraulic pump includes a pump module and a main housing, the pump module has a pump housing and a cover. A pump element is arranged in the pump housing and is connected to a rotor arranged outside the pump housing, and the cover is latched to the pump housing by a first detent connection. The main housing has a stator, within which the rotor is arranged, and the main housing is latched to the cover by a second detent connection.

20 Claims, 10 Drawing Sheets

(56) References Cited

U.S. PATENT DOCUMENTS

| | | | | |
|---|---|---|---|---|
| 2006/0083631 | A1* | 4/2006 | Israelson | F02M 37/08 417/423.1 |
| 2012/0224991 | A1* | 9/2012 | Lipinski | F04C 15/0069 264/138 |
| 2014/0079578 | A1* | 3/2014 | Irie | F04D 13/0693 417/423.14 |
| 2019/0085848 | A1* | 3/2019 | Sinico | F04D 13/0686 |
| 2020/0271121 | A1* | 8/2020 | Arnoldi | H02K 5/10 |
| 2021/0003132 | A1* | 1/2021 | Imai | F04D 29/628 |

FOREIGN PATENT DOCUMENTS

| | | | |
|---|---|---|---|
| GB | 2502343 | A | 11/2013 |
| WO | WO 2007/033846 | A1 | 3/2007 |
| WO | WO 2015/082462 | A1 | 6/2015 |

OTHER PUBLICATIONS

Extended European Search Report issued Nov. 10, 2023, in corresponding European Patent Application No. 23177431.6, 7 pages.

* cited by examiner

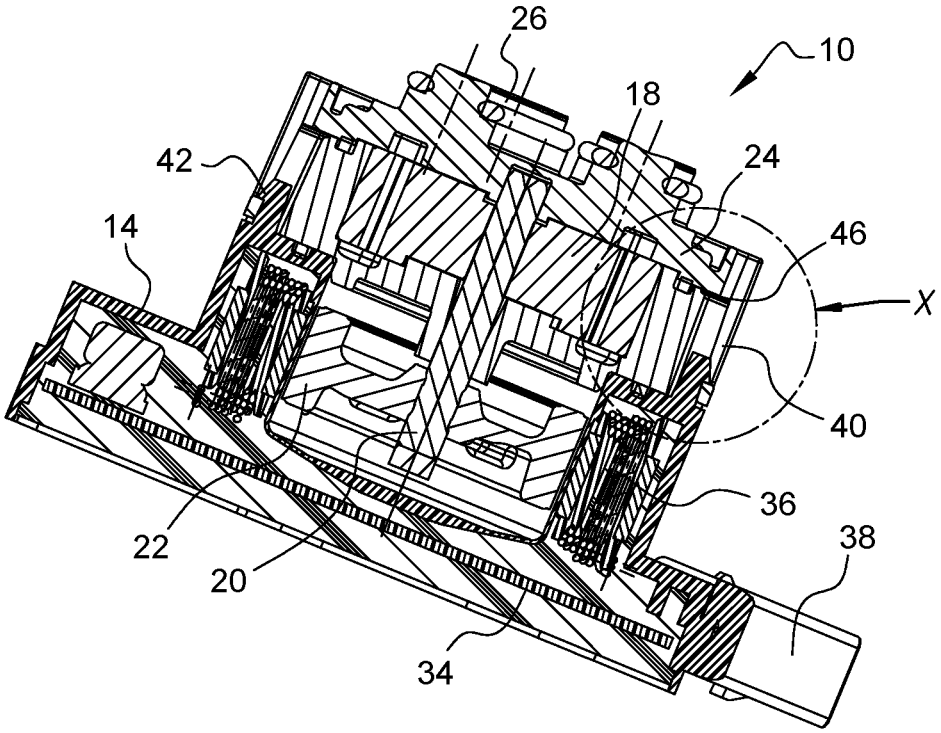
Fig. 9
Fig. 10
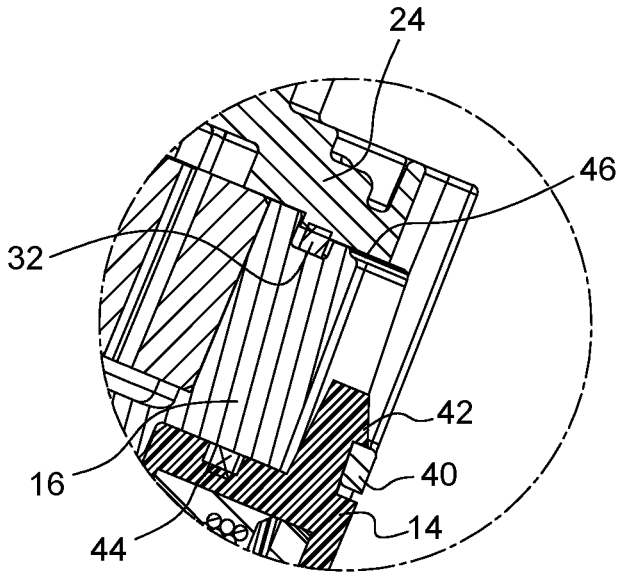

HYDRAULIC PUMP AND MODULE FORMED FROM SUCH A HYDRAULIC PUMP AND A RECEPTACLE

The invention relates to a hydraulic pump, as can be used in particular in motor vehicles, in order to provide a hydraulic fluid flow for cooling (for example for cooling friction clutches), for supplying an actuator (for example for actuating a clutch or a gear actuator) or for lubrication (for example for lubricating a gearbox). The invention also relates to a module comprising such a hydraulic pump and a receptacle in which the hydraulic pump is mounted.

It is known that the components of the hydraulic pumps can be pre-assembled in different configurations to form modules, which are then assembled together to form the finished hydraulic pump.

The object of the invention is to provide a hydraulic pump which is particularly advantageous in respect of the assembly.

To achieve this object, a hydraulic pump comprising a pump module and a main housing is provided according to the invention, wherein the pump module has a pump housing and a cover, wherein a pump element is arranged in the pump housing and is connected to a rotor arranged outside the pump housing, wherein the cover is latched to the pump housing by means of a first detent connection, wherein the pump housing has a stator, within which the rotor is arranged, and wherein the pump housing is latched to the cover by means of a second detent connection. The invention is based on the fundamental concept of using the cover with a dual function. On the one hand, the cover is used to close the pump housing with a pump element arranged therein. On the other hand, the cover is used to connect the pump module, formed of pump housing and cover, to the main housing. This results on the whole in a hydraulic pump which consists of very few individual components.

According to a preferred embodiment of the invention, it is provided that the latch connection has a deformation portion. The deformation portion makes it possible to elastically prestress the detent connection, so that the desired tightness of the modules fastened to one another is achieved even after any slackening.

According to an embodiment of the invention it is provided that the cover has a plurality of detent tabs, which extend along the outer side of the pump housing and are part of the first and the second latch connection. The cover is embodied here in the manner of a cap, which is fitted on the pump housing. The detent tabs facilitate the assembly process.

The pump housing can be provided with a clearance in regions that are adjacent to the detent tabs. The clearance makes it possible to elastically deform the cover in the region of the detent tabs in order to apply the desired prestress force.

As part of the detent connection, the pump housing and/or the main housing can each have at least two detent protrusions, which cooperate with detent tabs of the cover. The applied fastening forces can be diverted directly into corresponding housings by the detent protrusions arranged on the corresponding housing.

According to an embodiment it is provided that the detent protrusions are elastically deformable. This is a further possibility for prestressing the detent connection elastically in the assembly direction.

The invention also creates a module comprising a hydraulic pump of the aforementioned kind and a receptacle for the hydraulic pump, wherein a fastening device is provided, by means of which the hydraulic pump is fastened in the receptacle, wherein the fastening device is elastically deformable. The fastening device is elastically prestressed when the hydraulic pump is mounted in the receptacle, so that the hydraulic pump bears with the desired prestress against associated contact faces in the receptacle. The prestress does not decrease significantly on account of the elastic deformation of the fastening device, not even in the event of any slackening.

According to an embodiment the main housing is provided with two fastening arms, which can be connected to the receptacle so that the hydraulic pump is loaded in the receptacle, wherein the fastening arms are elastically deformable. The fastening arms can protrude laterally from the main housing and can be deformable in the manner of leaf springs.

According to an embodiment of the invention in the component chain receptacle, cover, pump housing, main housing at least one seal elastically deformable in the mounting direction is provided. The seal, similarly to the elastically deformable fastening device, ensures that the necessary prestress force and sealing are maintained, even in the event of any slackening.

The invention will be described below on the basis of an embodiment which is illustrated in the appended drawings. In the drawings:

FIG. 9 shows a section along the plane IX-IX in FIG. 4;

FIG. 10 shows the detail X in FIG. 9 on an enlarged scale;

Figure 1:
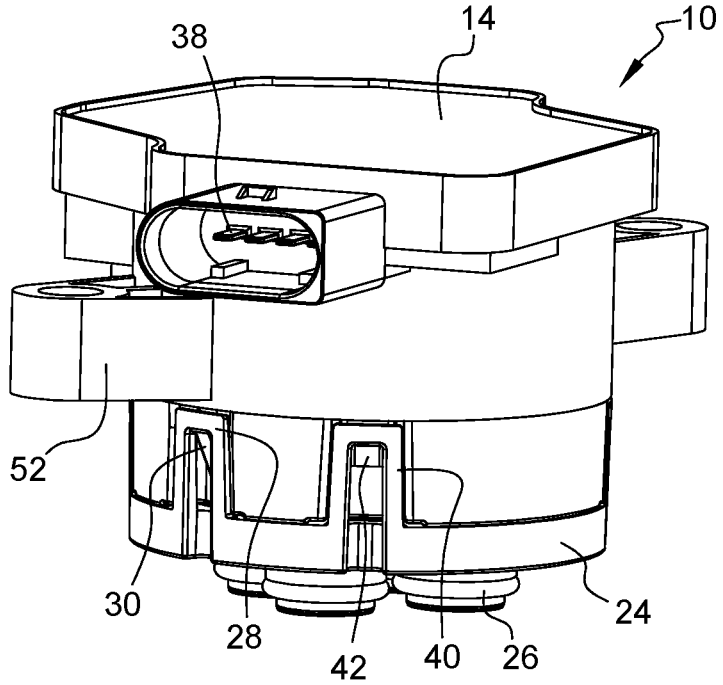
FIG. 1 shows a first perspective view of the assembled hydraulic pump.

A hydraulic pump 10 is shown in FIGS. 1 to 15, which can be used in particular to provide a hydraulic fluid flow for cooling, lubrication and shifting purposes in a motor vehicle. The hydraulic fluid flow can be used, for example, to cool a friction clutch or to lubricate a gearbox, or it can be supplied to an actuator by means of which a clutch or a gearbox is shifted.

The hydraulic pump 10 has a pump module 12 (see FIG. 12) and a main housing 14. Generally expressed, the pump assembly 12 represents the mechanical side of the pump, whereas the main housing 14 represents the electronic or electrical side of the hydraulic pump.

The pump module 12 has a pump housing 16 (see for example FIG. 5), in which there is arranged a pump element 18.

In the exemplary embodiment shown, the pump is a double-flow vane pump. However, other pump types may also be used.

The pump element 18 is mounted for conjoint rotation on a drive shaft 20, on which there is in turn mounted a rotor 22, likewise for conjoint rotation. The pump element 18 is received here inside the pump housing 16, whereas the rotor 22 lies outside the pump housing (see also FIG. 12).

A cover 24 is fitted on the pump housing 16 and closes off the space in the pump housing 16 in which the pump element 18 is received. The cover 24 additionally has intake and pressure ports 26, through which hydraulic fluid can be drawn in and discharged.

The cover 24 is connected to the pump housing 16 by means of a first detent connection. The detent connection here has a plurality of detent tabs 28, which are formed in one piece with the cover 24.

In the shown embodiment two diametrically opposed detent tabs 28 are used.

Figure 6:
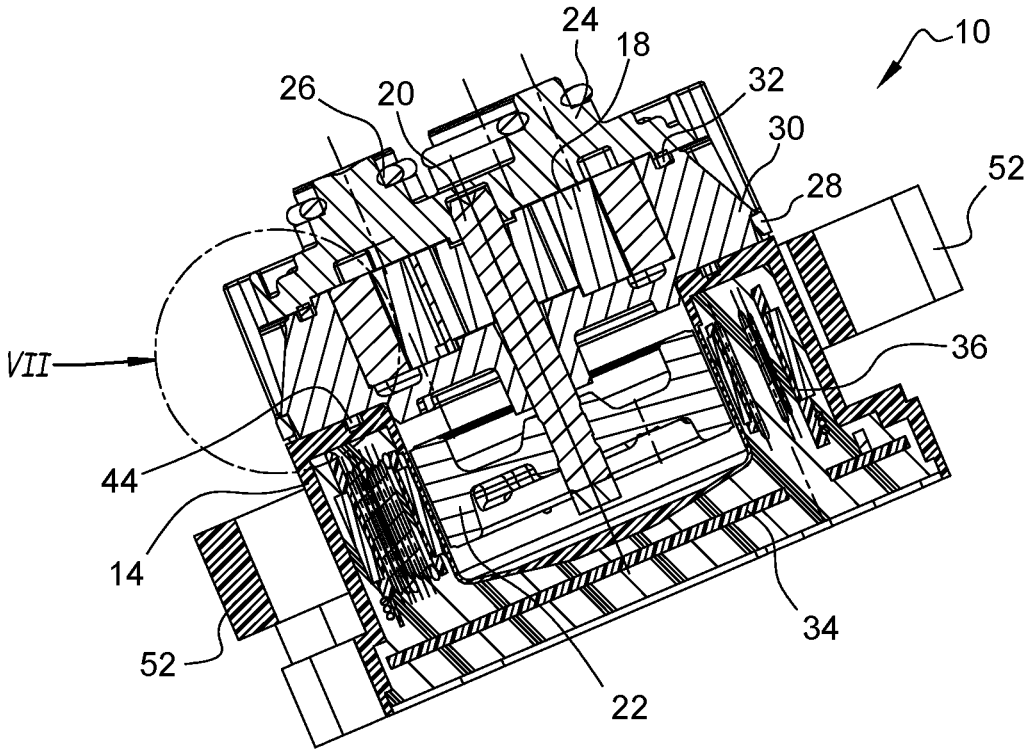
FIG. 6 shows a section along the plane VI-VI in FIG. 4.
Figure 7:
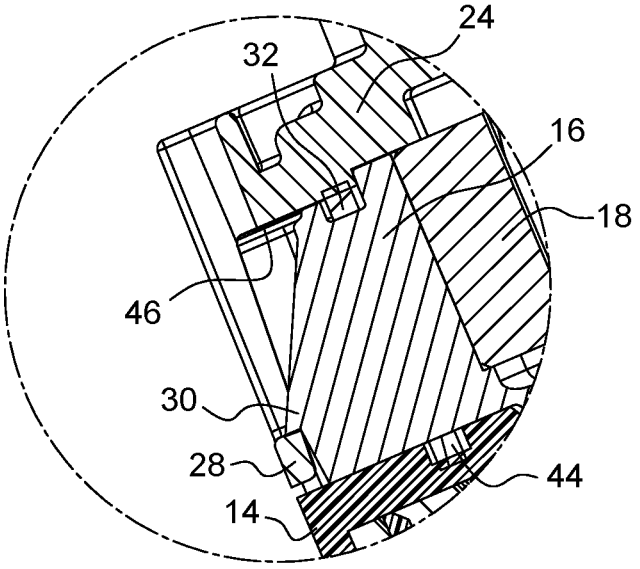
FIG. 7 shows the detail VII in FIG. 6 on an enlarged scale.
Figure 8:
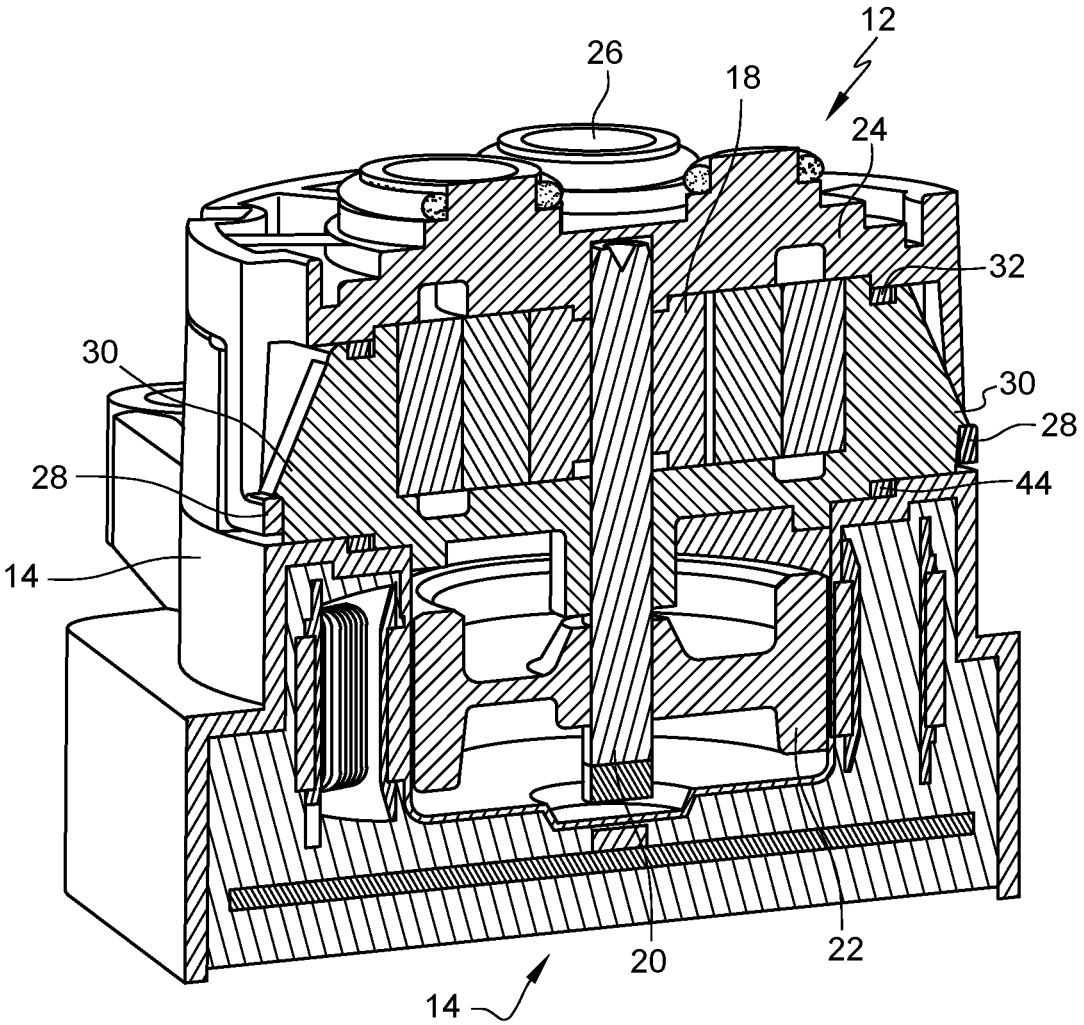
FIG. 8 shows the hydraulic pump cut along the plane VI-VI in a perspective view.

Two detent tabs 30, which are formed in one piece with the pump housing 24 and behind which the detent tabs 28 latch are also part of the detent connection (see in particular FIGS. 6 to 8).

A seal 32 is arranged between the pump housing 16 and the cover 24 and is elastically compressed when the cover is in the assembled state. In this way, a seal is ensured between the pump housing 16 and the cover 24.

The main housing 14 has a printed circuit board 34, a stator 36 and a plug connection 38. The stator here surrounds a receiving space for the rotor 22 (see for example FIG. 9).

Figure 11:
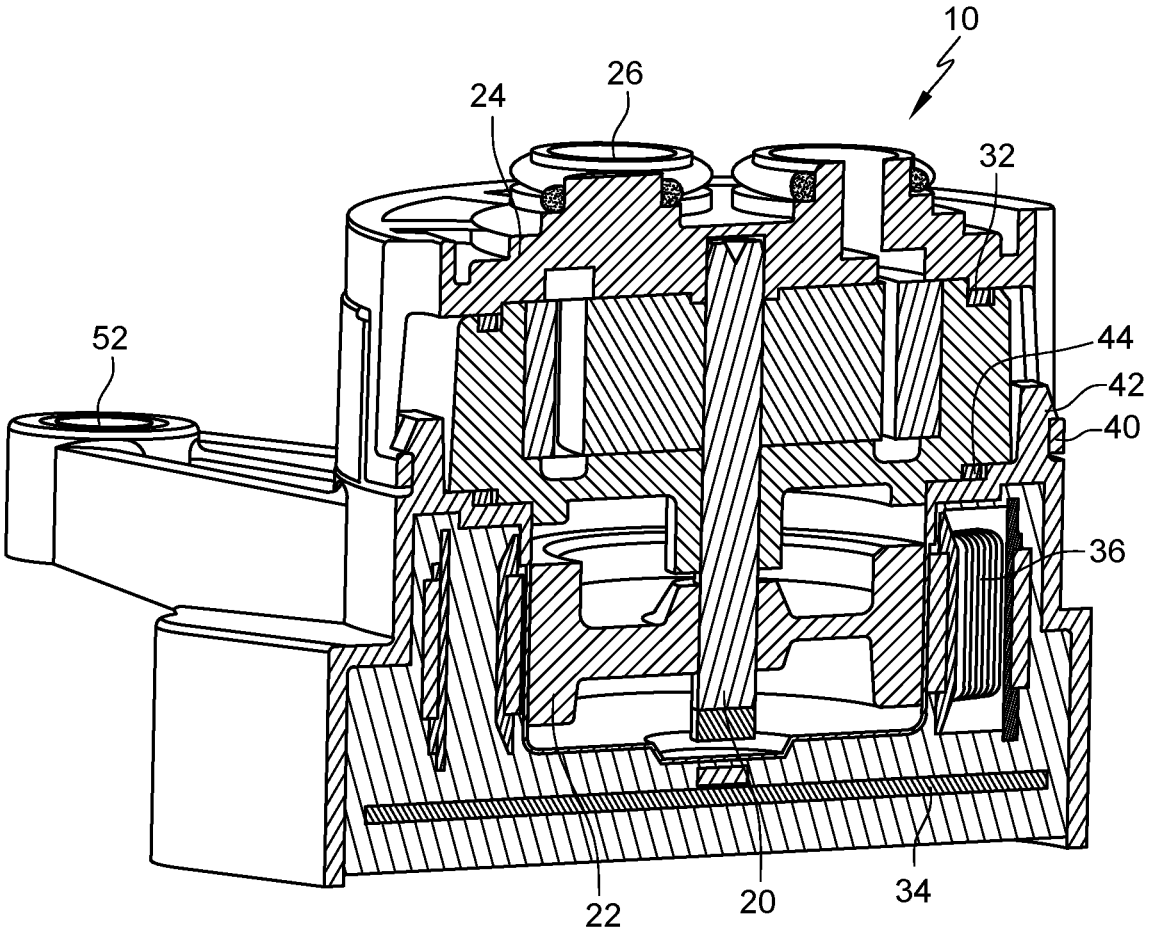
FIG. 11 shows the hydraulic pump cut along the plane IX-IX in a perspective view.
Figure 12:
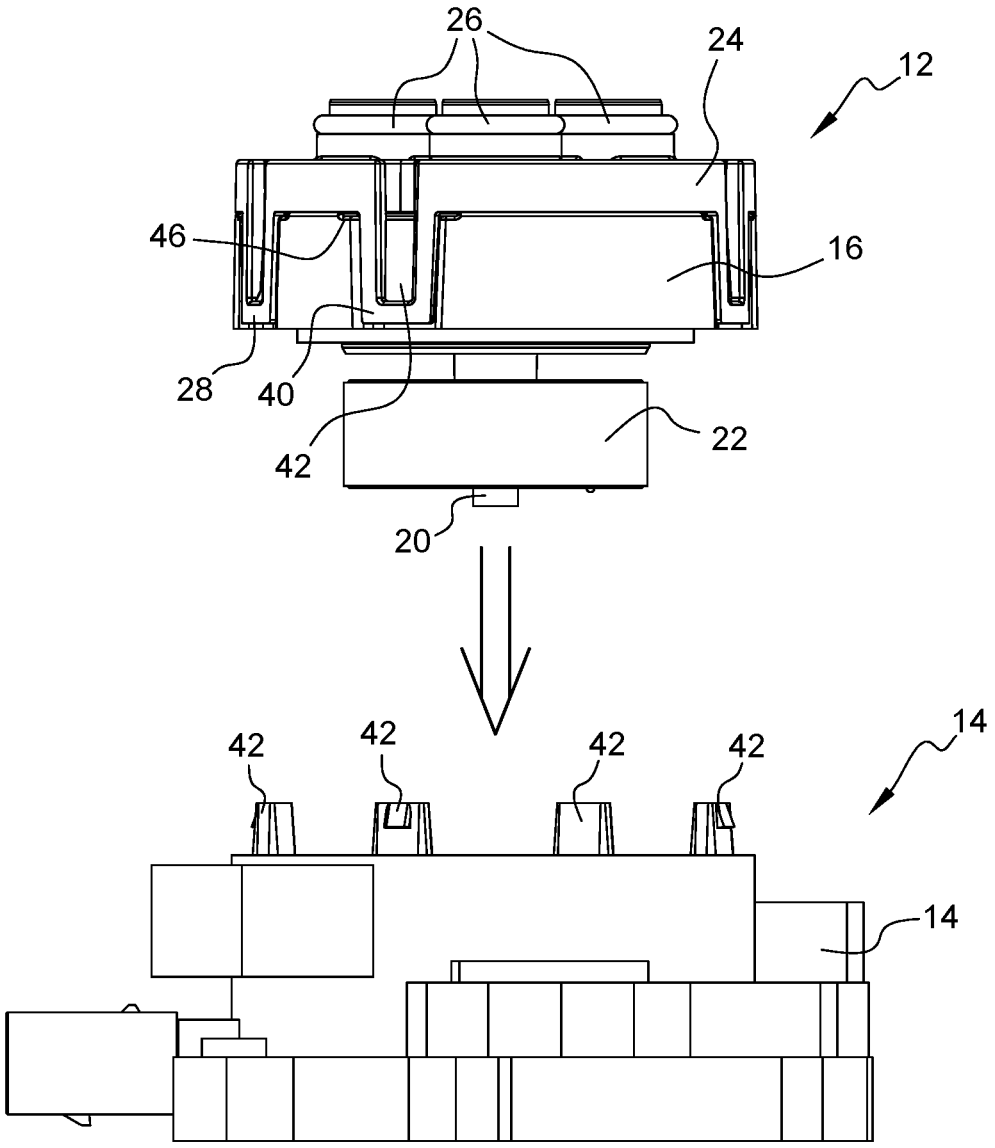
FIG. 12 shows schematically the assembly of the pump module on the main housing in a side view.
Figure 13:
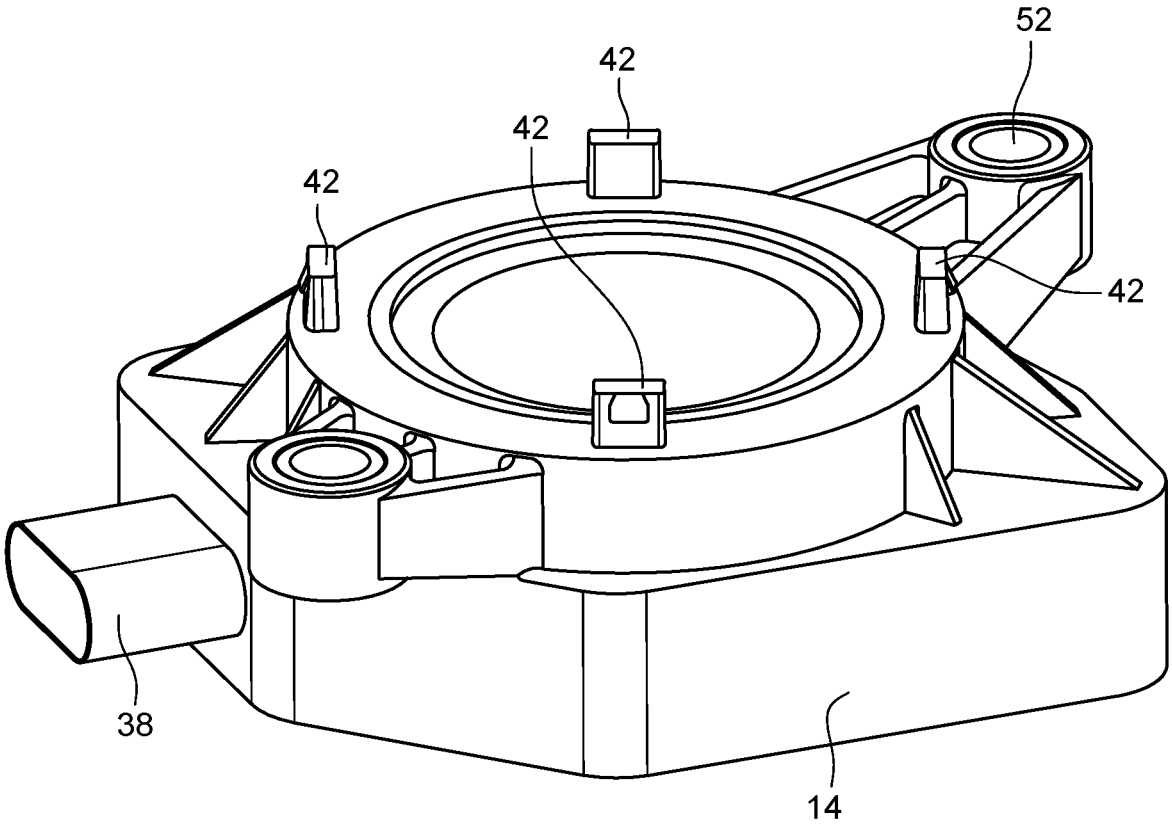
FIG. 13 shows the main housing in a perspective view.
Figure 14:
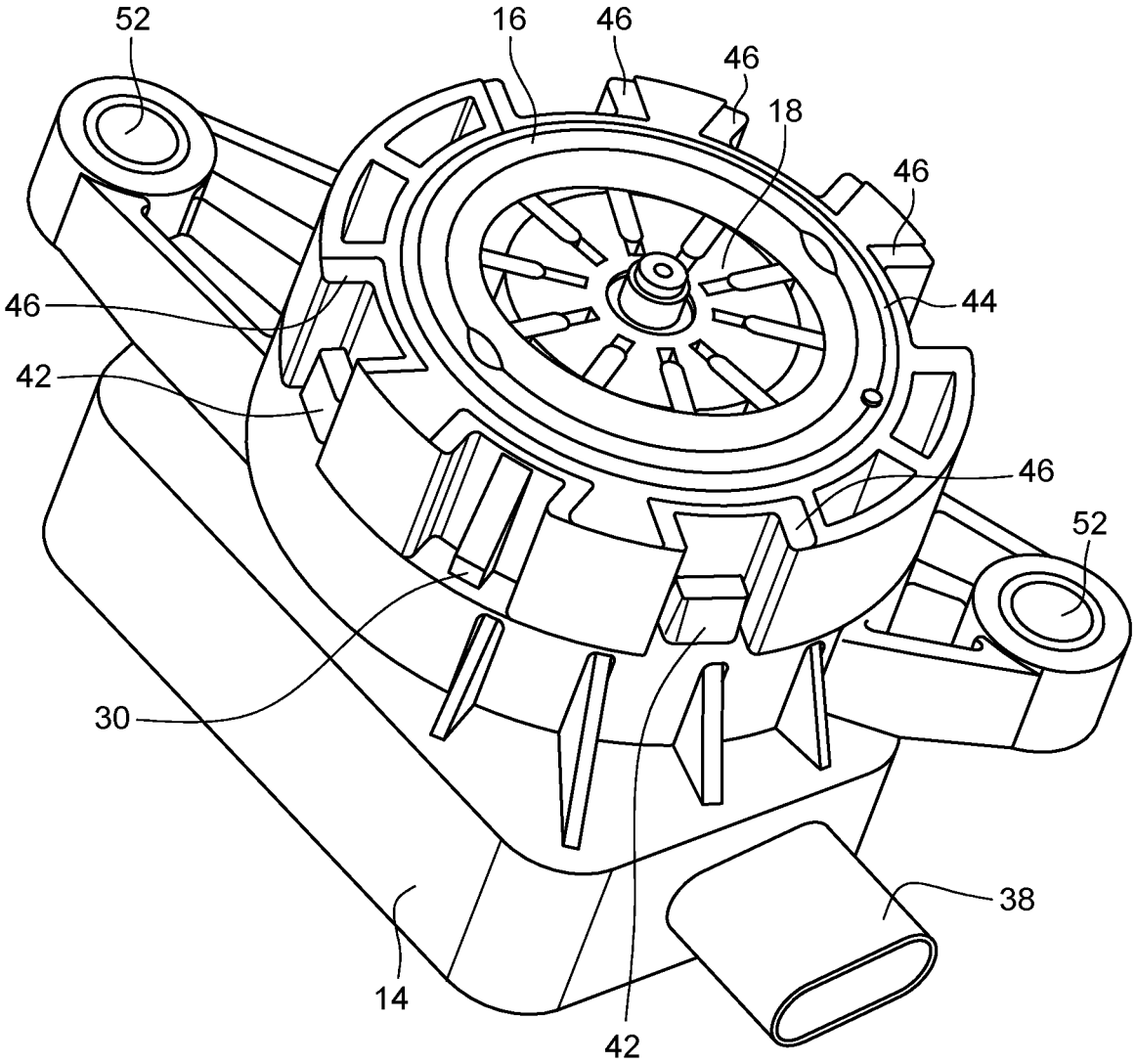
FIG. 14 shows the assembled hydraulic pump in a perspective view, wherein, for better understanding, the cover is not shown.
Figure 15:
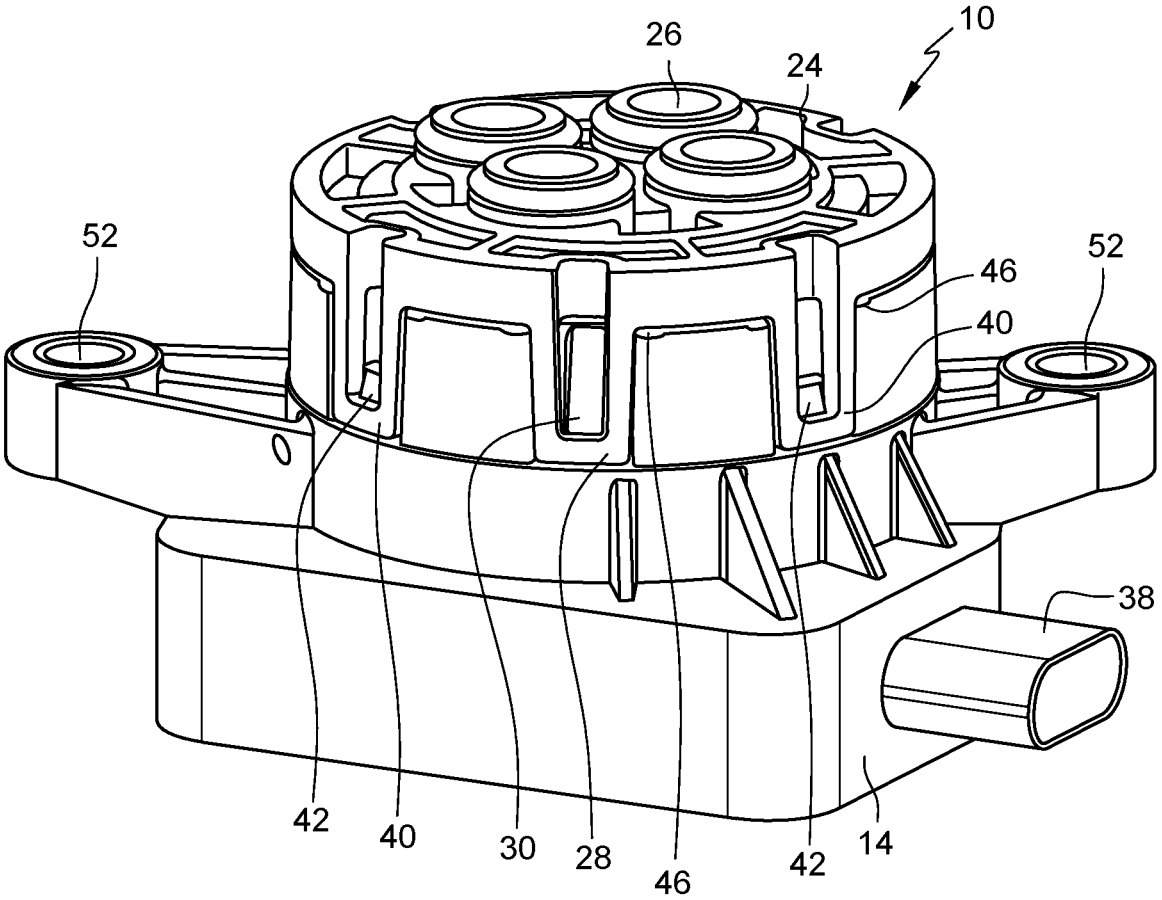
FIG. 15 shows the assembled hydraulic pump in a perspective view.

The pump module 12 formed from the pump housing 16 and the cover 24 (and the further components such as the pump element 18, the drive shaft 20 and the rotor 22) is connected to the main housing 14 by means of a second detent connection (see for example FIG. 11).

The second detent connection has a plurality of detent tabs 40, which are likewise formed in one piece with the cover 24, and also a plurality of detent protrusions 42 (see for example FIG. 13), which are formed in one piece with the main housing 14.

Figure 2:
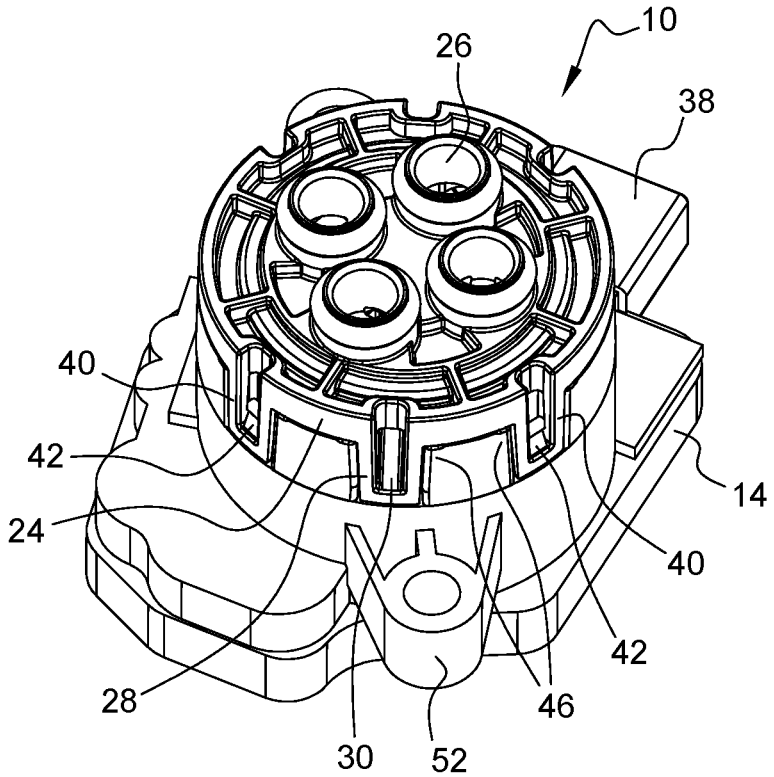
FIG. 2 shows a second perspective view of the assembled hydraulic pump.
Figure 3:
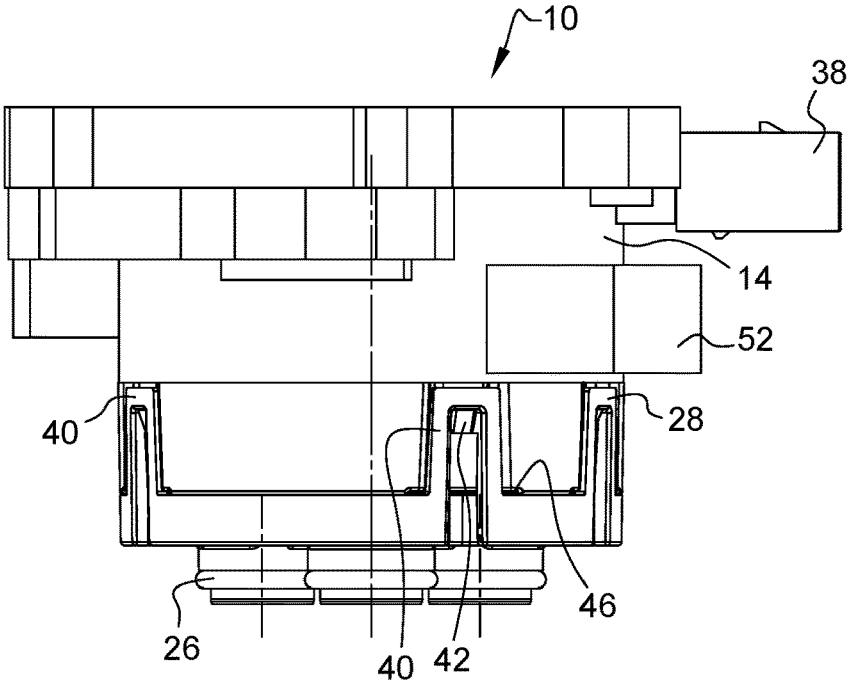
FIG. 3 shows a side view of the hydraulic pump in FIG. 1.
Figure 4:
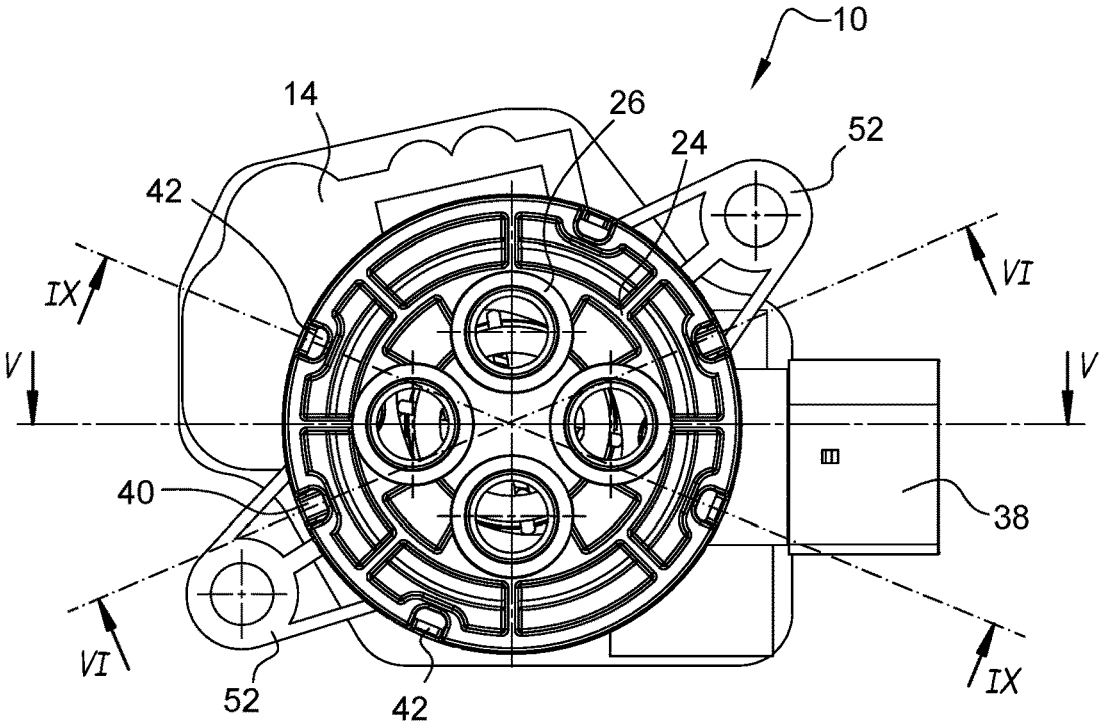
FIG. 4 shows a view from below of the hydraulic pump in FIG. 1.
Figure 5:
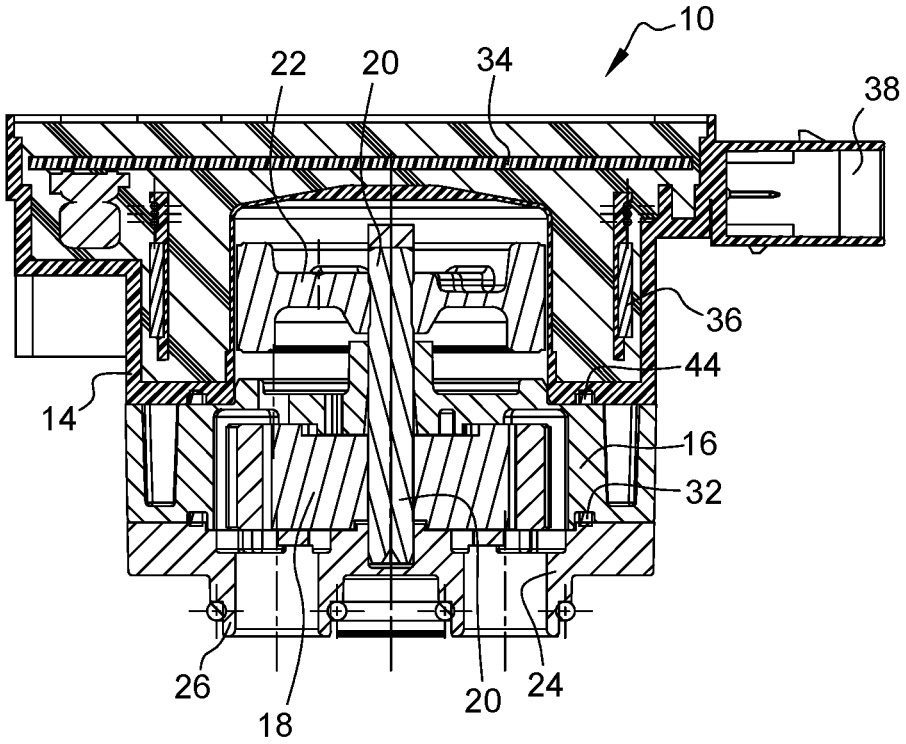
FIG. 5 shows a section along the plane V-V in FIG. 4.

The detent tabs 40 are arranged in the shown embodiment in pairs on one and the other side of the detent tab 28 of the first detent connection (see for example FIG. 2). Here, the detent tabs 40 of the second detent connection are formed identically to the detent tabs 28 of the first detent connection.

In order to assemble the hydraulic pump 10, the pump module 12 is first pre-assembled. In the pre-assembled state (see FIG. 12), the pump module 12 is pushed onto the main housing 14, wherein the detent tabs 40 of the second detent connection latch in behind the detent hooks 42 of the main housing 14. The hydraulic pump 10 is then assembled.

A seal 44 is arranged between the pump housing 16 and the main housing 14 and ensures the desired seal between the two components, The first and the second detent connection each have a deformation portion. Here, "deformation portion" refers here to a geometric form that makes it possible to elastically prestress the detent connection. This elastic prestress ensures that the components are then also fastened to one another and loaded relative to one another in the desired way, for example even in the event of any slackening.

The deformation portion is formed here by the region of the cover 16 in which the detent tabs 28, 40 are attached to the cover 24. The deformability is made possible by clearances 46 (see in particular FIG. 14), which are formed in the region of the detent tabs 28, 40 on the end face of the pump housing 16 facing the cover 24.

The clearances 46 make it possible to deform the cover 24, when assembled on the main housing 16, into the clearances 46 in the region of the two detent tabs 28, so that the detent tabs 28 are shifted temporarily beyond their actual position towards the side of the pump housing 16 remote from the cover 24. There, they can latch behind the detent tabs 30. If the assembly force acting on the cover 24 is then cancelled, the cover 24 springs back into its original position, and the detent tabs 28 pull the cover 24 against the pump housing 16.

Similarly, the cover 24, when the pump module 12 is mounted on the main housing 14, can be deformed into the clearances 46 in the region of the detent tabs 40 of the second detent connection by an assembly force, so that the detent tabs latch behind the detent protrusions 42. If the assembly force is then removed, the cover 24 springs back into its starting position in the region of the detent tabs of the second detent connection, so that the pump module 12 is fastened under elastic prestress to the main housing 14.

Figure 16:
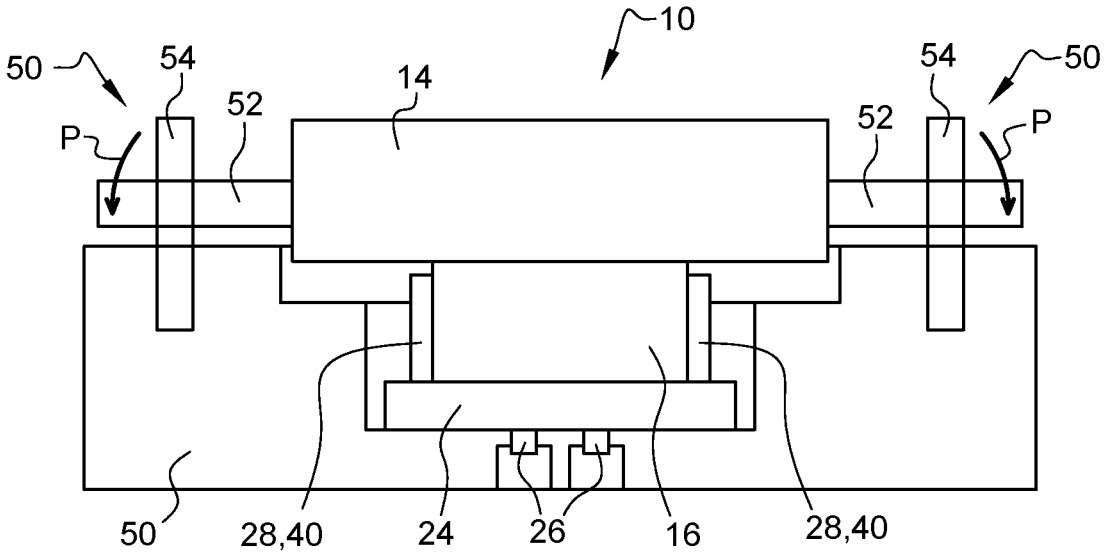
FIG. 16 shows the hydraulic pump mounted in a receptacle in a schematic view.

The hydraulic pump 10 is intended to be mounted in a receptacle 50 (see FIG. 16). In order to connect the hydraulic pump 10 to the receptacle 50, a fastening device 52 is provided, which is elastically deformable. Similarly to the case with the elastically prestressable detent connections, it can hereby be ensured that the hydraulic pump is permanently received with a desired prestress force in the receptacle 50 and bears against the associated contact faces of the latter.

The fastening device has two fastening arms 52 here, which are provided laterally on the main housing 14. They are formed in one piece with the main housing 14.

The two fastening arms 52 protrude on opposite sides from the main housing 14 (see FIG. 4), wherein they project noticeably, similarly to a leaf spring.

The fastening device furthermore has two fastening screws 54 shown schematically in FIG. 16, by means of which the fastening arms can be attached to the receptacle 50. Here, the fastening arms may be bent slightly (symbolized in FIG. 16 by the two arrows P), so that an elastic prestress is built up.

The invention claimed is:

1. A hydraulic pump comprising:

a pump module; and a main housing, wherein the pump module has a pump housing and a cover, wherein a pump element is arranged in the pump housing and is connected to a rotor arranged outside the pump housing, wherein the cover is latched to the pump housing by means of a first detent connection, wherein the main housing has a stator, within which the rotor is arranged, wherein the main housing is latched to the cover by means of a second detent connection, and wherein the first detent connection is separate from the second detent connection.

2. The hydraulic pump according to claim 1, wherein the first and the second detent connections each have a deformation portion.

3. The hydraulic pump according to claim 1, wherein the cover has a plurality of separate detent tabs, which extend along the outer side of the pump housing, each of the separate detent tabs are part of either the first detent connection or the second detent connection.

4. The hydraulic pump according to claim 3, wherein the pump housing is provided with a clearance in regions that are adjacent to the detent tabs.

5. The hydraulic pump according to claim 4, wherein the pump housing has at least two detent protrusions, which cooperate with detent tabs of the cover.

6. The hydraulic pump according to claim 3, wherein the main housing has at least two detent protrusions, which cooperate with detent tabs of the cover.

7. The hydraulic pump according to claim 5, wherein the detent protrusions are elastically deformable.

8. A module comprising a hydraulic pump according to claim 1 and a receptacle for the hydraulic pump, wherein a fastening device is provided, to which the hydraulic pump is fastened in the receptacle, wherein the fastening device is elastically deformable.

9. The module according to claim 8, wherein the main housing is provided with two fastening arms, which can be connected to the receptacle such that the hydraulic pump is loaded the receptacle, wherein the fastening arms are elastically deformable.

10. The module according to claim 8, wherein in one or more of the receptacle, the cover, the pump housing, and the main housing, at least one seal elastically deformable in the mounting direction is provided.

11. The hydraulic pump according to claim 2, wherein the cover has a plurality of separate detent tabs, which extend along the outer side of the pump housing, each of the separate detent tabs are part of either the first detent connection or the second detent connection.

12. The hydraulic pump according to claim 4, wherein the main housing has at least two detent protrusions, which cooperate with detent tabs of the cover.

13. The hydraulic pump according to claim 6, wherein the detent protrusions are elastically deformable.

14. The module comprising a hydraulic pump according to claim 2 and a receptacle for the hydraulic pump, wherein a fastening device is provided, to which the hydraulic pump is fastened in the receptacle, wherein the fastening device is elastically deformable.

15. The module according to claim 9, wherein in one or more of the receptacle, the cover, the pump housing, and the main housing, at least one seal elastically deformable in the mounting direction is provided.

16. The hydraulic pump according to claim 5, wherein the main housing has at least two detent protrusions, which cooperate with detent tabs of the cover.

17. The module comprising a hydraulic pump according to claim 3 and a receptacle for the hydraulic pump, wherein a fastening device is provided, to which the hydraulic pump is fastened in the receptacle, wherein the fastening device is elastically deformable.

18. The module comprising a hydraulic pump according to claim 4 and a receptacle for the hydraulic pump, wherein a fastening device is provided, to which the hydraulic pump is fastened in the receptacle, wherein the fastening device is elastically deformable.

19. The module comprising a hydraulic pump according to claim 5 and a receptacle for the hydraulic pump, wherein a fastening device is provided, to which the hydraulic pump is fastened in the receptacle, wherein the fastening device is elastically deformable.

20. The module comprising a hydraulic pump according to claim 6 and a receptacle for the hydraulic pump, wherein a fastening device is provided, to which the hydraulic pump is fastened in the receptacle, wherein the fastening device is elastically deformable.

* * * * *